US006269890B1

(12) United States Patent
Kremer et al.

(10) Patent No.: US 6,269,890 B1
(45) Date of Patent: Aug. 7, 2001

(54) TAP HOLE DRILL

(75) Inventors: Victor Kremer, Luxembourg (LU); Philippe Malivior, Thionville (FR); Emile Lonardi, Bascharage (LU)

(73) Assignee: Paul Wurth, S.A., Luxembourg (LU)

( * ) Notice: Subject to any disclaimer, the term of this patent is extended or adjusted under 35 U.S.C. 154(b) by 0 days.

(21) Appl. No.: 09/355,591

(22) PCT Filed: Jan. 15, 1998

(86) PCT No.: PCT/EP98/00196

§ 371 Date: Oct. 18, 1999

§ 102(e) Date: Oct. 18, 1999

(87) PCT Pub. No.: WO98/32881

PCT Pub. Date: Jul. 30, 1998

(30) Foreign Application Priority Data

Jan. 29, 1997 (LU) ..... 90-015

(51) Int. Cl.[7] ..... C21B 7/12; F27D 3/15
(52) U.S. Cl. ..... 173/193; 266/271
(58) Field of Search ..... 173/190, 193–195, 173/38, 42; 266/271; 248/647, 654

(56) References Cited

U.S. PATENT DOCUMENTS

| | | | | |
|---|---|---|---|---|
| 3,295,800 | * | 1/1967 | Karl-Erik Qvarnstrom et al. | 173/193 |
| 3,306,374 | | 2/1967 | Stromnes . | |
| 3,374,975 | | 3/1968 | Bronder . | |
| 3,493,200 | * | 2/1970 | Huffman | 173/193 |
| 4,037,828 | | 7/1977 | Terada et al. . | |
| 4,108,254 | * | 8/1978 | Johansson | 173/193 |
| 4,796,869 | * | 1/1989 | Mailliet et al. | 266/271 |
| 5,308,047 | * | 5/1994 | Lonardi et al. | 266/271 |
| 5,884,712 | * | 3/1999 | Hakkinen | 173/193 |

FOREIGN PATENT DOCUMENTS

| | | |
|---|---|---|
| 1962953 | 6/1971 | (DE) . |
| 2630232 | 4/1977 | (DE) . |
| 0816516 | 1/1998 | (EP) . |
| 2604511 | 4/1988 | (FR) . |
| 88782 | 12/1997 | (LU) . |

* cited by examiner

*Primary Examiner*—Scott A. Smith
(74) *Attorney, Agent, or Firm*—Smith, Gambrell & Russell LLP

(57) ABSTRACT

A taphole boring machine serving two tapholes includes a support structure, a mount and a suspension device of which the mount is secured on the supporting structure and the suspension device has a tilting device for the mount with the suspension device further including a mechanism within a frame, a first drive and two connection points with a mechanism designed in such a way that a positively guided translation of two connection points in relation to the frame can be produced by a drive pulse of the first drive so that a connecting line through the two connection points remains parallel with itself during such movement.

18 Claims, 3 Drawing Sheets

TAP HOLE DRILL

The invention relates to a taphole drilling machine, in particular a taphole drilling machine to serve several tapholes on a shaft furnace.

BACKGROUND OF THE INVENTION

Modern blast furnaces usually have several tapholes. Each of these taholes is served by its own drilling machine. As an efficient taphole drilling machine is relatively expensive, it would, of course, be interesting for cost reasons to develop a machine which can be used for several adjacent tapholes at the same time.

A taphole drilling machine of this type was already described in DE-A-19 62 953 in 1967. This machine comprises a fixed bracket and an arm, the first end of which can be swivelled about a first axis and is mounted in the fixed bracket. The arm, which can be swivelled by a drive from a first operating position in front of the first taphole into a second operating position in front of the second taphole, carries at its free end a vertical pivot on which a mount is mounted. A control rod is connected by swivel joints to a fixed lever arm on the bracket and to a crank firmly seated on the pivot. These form a four-link swivel joint mechanism, in which a swivelling movement of the arm about the first axis produces a swivelling movement of the mount about the second axis. To allow adaptation of the angle of inclination of the drilling axis to the respective taphole, the mount is connected by a horizontal swivelling joint to vertical pivots, and a tilting cylinder is arranged between the mount and a flange secured rigidly to the vertical pivot. To adapt the height of the drilling axis to the respective taphole on the other hand it is proposed that the mount be brought to different points of proximity to the taphole, i.e. to limit the swivelling movement of the arm. However, the result is that only very small differences in height can be compensated, because firstly the swivelling movement of the arm determines the final position of the mount and, secondly, the distance between the mount end and the taphole should preferably be identical.

A rock drilling machine, as used in mines, for example, is known from U.S. Pat. No. 3,349,975. This rock drilling machine has a parallelogram mechanism with a frame, three links and four joints, which permits parallel displacement of a drill mount by means of a first pressure cylinder. A second pressure cylinder is connected between the parallelogram mechanism and the drill mount and permits tilting of the drill mount. An additional rotary motor permits 360° rotation of the parallelogram mechanism about a horizontal axis. The aim of the device is to permit universal alignment of the drill mount via a hydraulic control system in relation to a horizontal axis, so that the rock drilling machine can drill several holes without having to be repositioned.

A taphole plugging machine, in which a mud gun is suspended by two articulated supporting links from a supporting structure, is known from FR-A-2 604 511. A pressure cylinder permits swivelling of the mud gun in a vertical plane and thus firm contact with its nozzle against the taphole. One of the two supporting links is longitudinally adjustable, so that the inclination of the mud gun can be adapted to the inclination of a taphole.

There is a need for a taphole drilling machine which permits variation in the height and inclination of the drilling machine to serve two tapholes, which can approach two tapholes with a different height and inclination in an optimum manner.

SUMMARY OF THE INVENTION

In the taphole drilling machine according to the invention the suspension device has a mechanism with a frame, a first drive and two connection points. The mechanism is designed in such a way that a positively guided translation of the two connection points in relation to the frame can be produced by a drive pulse of the first drive in such a way that a connecting line through the two connection points remains parallel with itself during this movement. A tilting device is provided with a connection joint, a supporting joint and a second drive and is designed in such a way that the distance between the connection joint and the supporting joint is adjustable by a drive pulse of the second drive. It is mounted via the connection joint on a first of the two connection points of the mechanism. In a first embodiment of the taphole drilling machine according to the invention the tilting device is connected via its supporting joint to the mount, the second connection point of the mechanism by a supporting joint to the mount and the frame to the supporting structure. In a second embodiment of the taphole drilling machine according to the invention the tilting device is connected via its supporting joint to the supporting structure, the second connection point of the mechanism by a supporting joint to the supporting structure and the mount to the frame. In both forms of construction the height of the mount can be adjusted via a single drive without changing the inclination of the mount.

According to the invention the mechanism is driven by a first pressure cylinder, which has a stroke limiting device with two independently adjustable strokes. The drill mount, which is raised into a rest position when approaching a taphole, can thus be lowered to the level of two tapholes at different heights in the operating position. The tilting device is driven by a second pressure cylinder, which likewise has a stroke limiting device with two independently adjustable strokes, so that the drill mount, which is advantageously in a horizontal rest position when approaching a taphole, can be adapted to the inclination of two tapholes with different inclination in the operating position.

In a preferred simple and space-saving embodiment the mechanism comprises a frame and three links connected by four swivel joints A, B, C and D. In this mechanism the distance between joint A and joint D corresponds to the distance between joint B and joint C, the distance between joint A and joint B to the distance between joint D and joint C and the distance between joint A and the supporting joint E of the mechanism to the distance between joint B and the supporting joint F of the tilting device.

Alternatively the mechanism could also have two links arranged in an X-shape, which are connected in their centre by an additional swivel joint. The frame and a third link are then each connected by a simple swivel joint and a combined turning and sliding joint to the ends of the two links in an X-shaped arrangement, the geometrical arrangement of these swivel joints advantageously corresponding to the geometrical arrangement of the corner points of a rectangle. This form of construction has the advantage that a pure vertical displacement of the mount can be achieved without horizontal movement components. However, it is far more complicated in its construction as a result of the turning and sliding joint and requires substantially more space.

The mechanism is advantageously driven by a pressure cylinder but could, of course, also comprise a rotary drive of one of the links. The pressure cylinder advantageously has a stroke limiting device with two independently adjustable strokes, so that the mount, which is advantageously raised to a rest position when approaching a taphole, can be lowered to the level of two tapholes of different height in the operating position.

The tilting device is advantageously designed as a pantograph. The second pressure cylinder can be mounted particularly easily on this pantograph. By opening and closing the pantograph the second pressure cylinder enables the distance between the connection joint and the supporting joint of the tilting device to be adjusted. The pressure cylinder of the tilting device also advantageously has a stroke limiting device with two independently adjustable strokes, so that the mount, which is advantageously in a horizontal rest position when approaching a taphole, can be adapted to the inclination of two tapholes of different inclination in the operating position.

The foregoing and additional objects and features of the invention will become apparent from the following description in which preferred embodiments have been set forth in detail in conjunction with the accompanying drawings.

DESCRIPTION OF THE PREFERRED EMBODIMENTS

Figure 1:
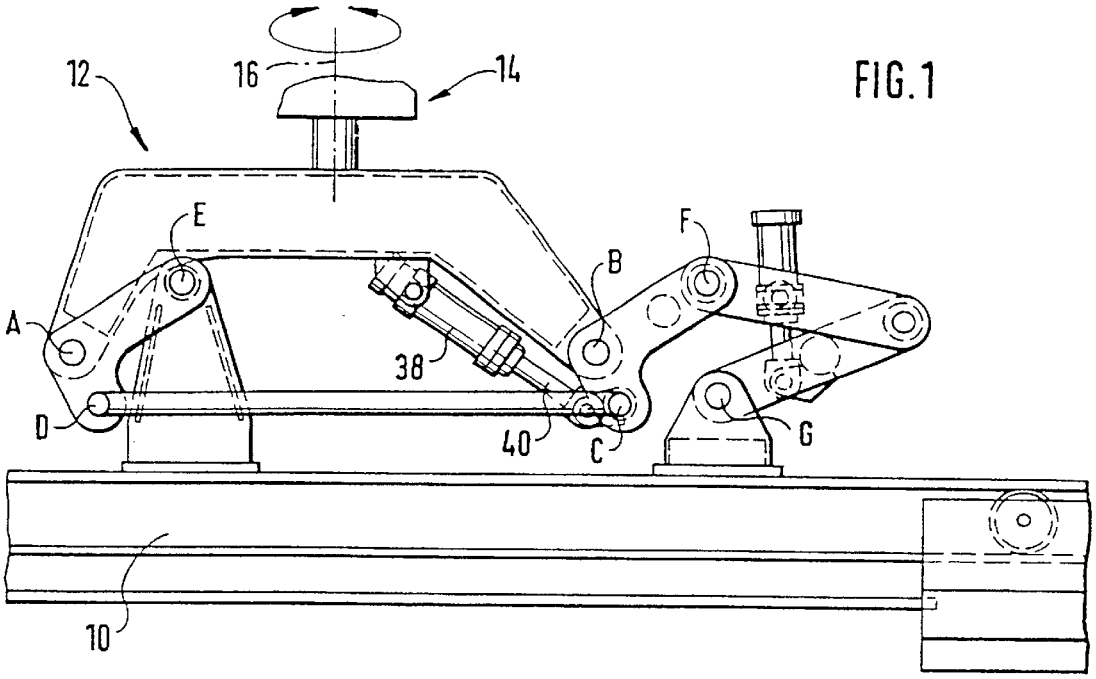
FIG. 1 is a partial view of a taphole drilling machine according to the invention in a rest position.
Figure 2:
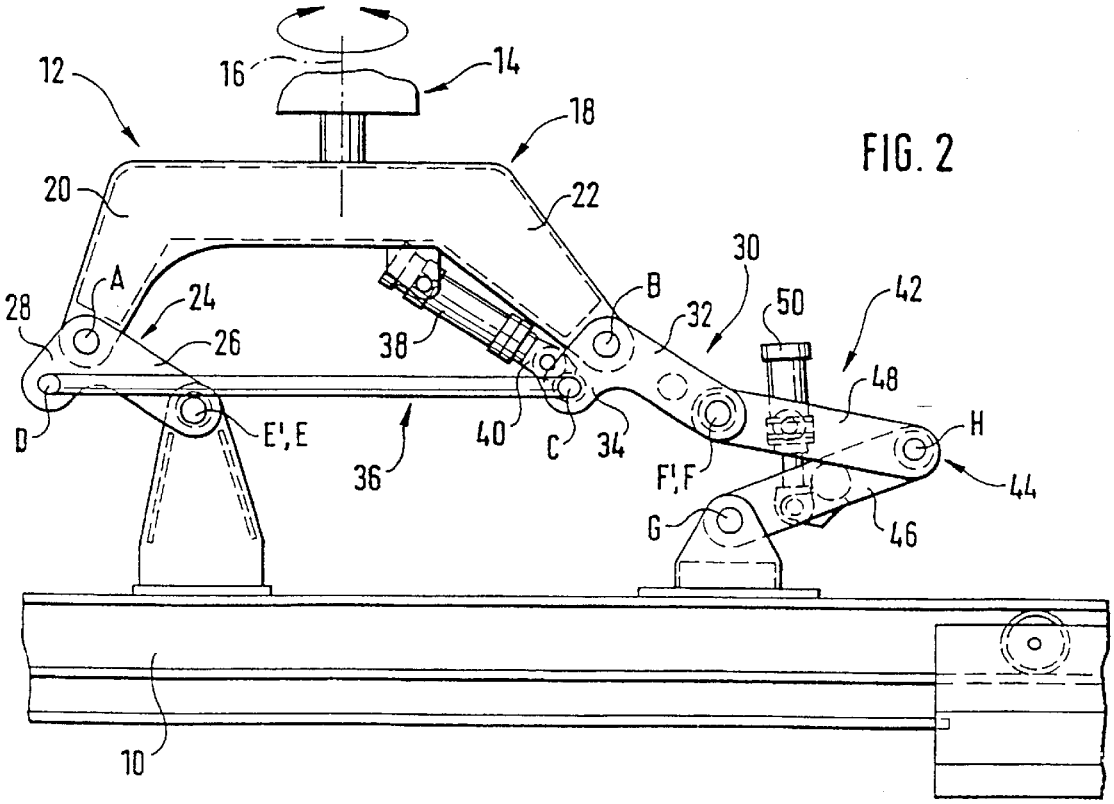
FIG. 2 is a partial view of the taphole drilling machine in FIG. 1 in an operating position.
Figure 3:
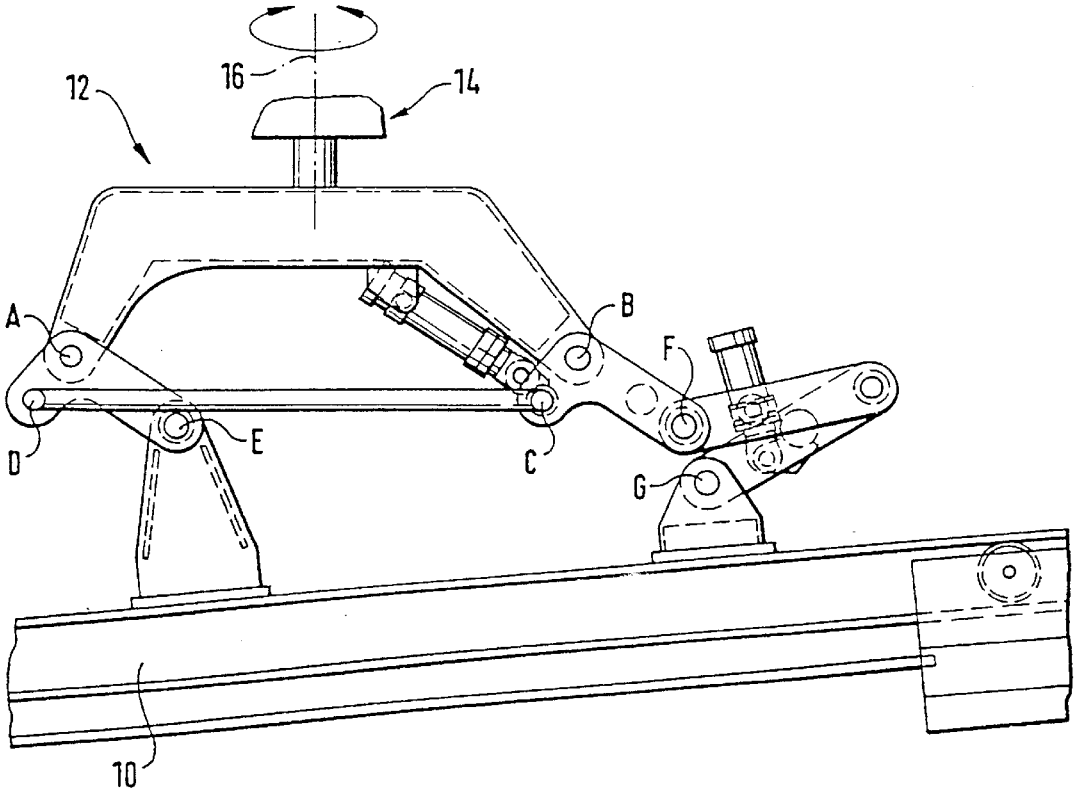
FIG. 3 is a partial view of the taphole drilling machine in FIG. 1 in a third position.

A mount 10 (shown only in section) and a suspension device 12, by means of which the mount 10 is mounted on a supporting structure 14, can be seen in FIGS. 1 to 3. For the sake of simplicity the supporting structure 14 is shown only schematically in the figures. Such a supporting structure may comprise, for example, a rotatable arm, on the free end of which the suspension device 12 is rotatable about an axis 16 (indicated by a broken line). An advantageous embodiment of such a supporting structure 14 with an arm is described, for example, in the patent applications of the applicant LU 88799 dated Aug. 1, 1996 and LU 88782 dated Jun. 28, 1996, the entire disclosure of which is included by reference in the present application. In an alternative embodiment the supporting structure 14 could, however, likewise comprise a car guided by rails, which carries the suspension device 12.

The suspension device 12 is described in more detail below with the aid of FIG. 2. It comprises a flat, four-link mechanism with four swivel joints. A first link 18 is designed as a mechanism frame and mounted on the supporting structure 14. This first link 18 has two legs 20 and 22. The first leg 20 is connected via a joint A to a second link 24. The latter is L-shaped with a first arm 26 and a second arm 28, the joint A being arranged at the point of intersection of the two 25 arms 26 and 28. The second leg 22 of the first link 18 is connected via a joint B to a third link 30. The latter is likewise L-shaped with a first arm 32 and a second arm 34, the joint B being arranged at the point of intersection of the two arms 32 and 34. A fourth link 36, which is designed, for example, as a rod, is connected via a joint D to the second arm 28 of the second link 24 and via a joint C to the second arm 34 of the third link 30. The four links 18, 24, 30 and 36 designed in such a way that the distance between joint A and joint D corresponds to the distance between joint B and joint C, and the distance between joint A and joint B to the distance between joint D and joint C. The mechanism has two connection points E' and F'. The connection point E' is located on the first arm 26 of the second link 24 and a swivel joint E connecting the mechanism to the mount 10 is assigned to it. The connection point F' is located on the first arm 32 of the third link 30.

The drive of the four-link mechanism described above is formed by a pressure cylinder 38. The latter is pivoted with its first end on the frame 18 and with its second end on the second arm of the third link 30 in the mechanism. In FIG. 2 the piston rod 40 of the pressure cylinder 38 is retracted. By contrast the piston rod 40 of pressure cylinder 38 is extended in FIG. 1. The extension of piston rod 40 caused rotation of the third link 30 about the joint B. This rotation was transmitted to the second link 24 via the fourth link 36. By virtue of the above-mentioned arrangement of joints A, B, C and D at the corner points of a parallelogram the angle of rotation of the second link 24 about the joint A corresponds exactly to the angle of rotation of the third link 30 about the joint B.

A tilting device 42 is connected via a connection joint F at the connection point F'to the first arm 32 of the third link 30 and via a supporting joint G to the mount 10. The distance between joint A and the supporting joint E corresponds to the distance between joint B and the connection joint F, with the result that a drive pulse of the first pressure cylinder 38 produces a positively guided translation of the supporting joint E and the connection joint F in relation to the frame 18, so that a hypothetical connecting line through the two connection points E' and F' remains parallel with itself during this movement. It follows that the mount 10 can likewise be raised and lowered parallel with itself by the pressure cylinder 38. The height of the drilling axis can thus be fixed without changing the inclination of the mount 10 and thus the inclination of the drilling axis. It should be particularly emphasized that the mechanism described above is of extremely compact construction and simultaneously introduces forces in the longitudinal direction of the mount 10 relatively rigidly into the supporting structure 14. The tilting device 42 is designed in such a way that the distance between connection joint F and supporting joint G is adjustable. In the form of construction shown it comprises, for example, a two-link pantograph 44 with a joint H. A pressure cylinder 50 is pivoted at one end of the first link 46 and at the other end on the second link 48 of the pantograph 44 and thus enables the distance between joint F and joint G to be increased and reduced by opening and closing the pantograph 44. The pressure cylinder 50 could, of course, also be connected directly, i.e. without pantograph 44, via a connection joint F to the first arm 32 of the third link 30 and via a supporting joint G to the mount 10. However, the pressure cylinder 50 can be incorporated mechanically far more advantageously into the suspension device 12 by means of the pantograph 44. Comparison of FIG. 2 with FIG. 3 reveals that the distance between joints F and G was shortened by retraction of the piston rod of the pressure cylinder 50. Consequently the supporting joint G was raised in relation to the supporting joint E, so that the mount 10 is inclined forwards.

It should be noted that the same result is achieved if the mechanism frame is formed e.g. by the mount and the two supporting joints E and G are connected to the supporting structure.

Figure 4:
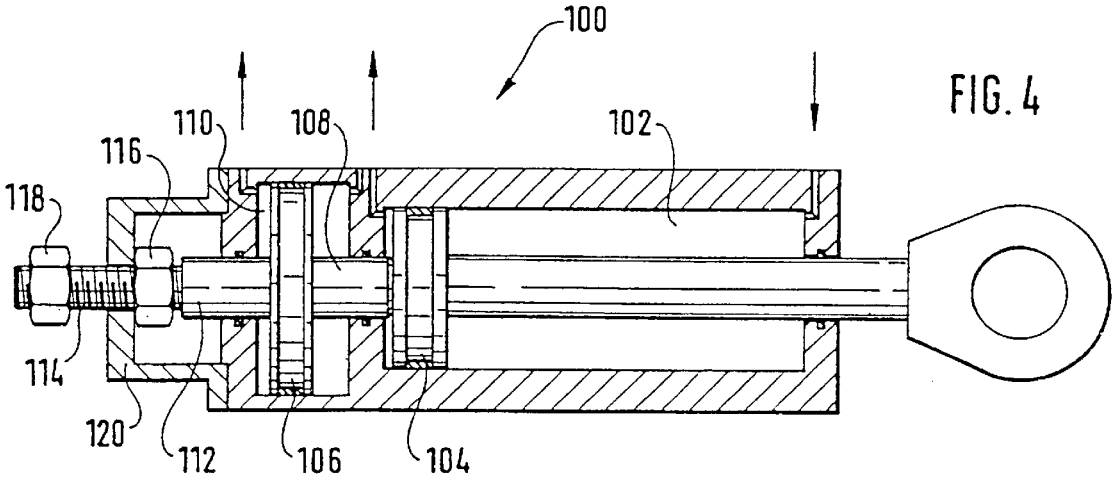
FIG. 4 is a longitudinal section through an advantageous embodiment of a pressure cylinder for a suspension device of a taphole drilling machine according to the invention, the main piston assuming a first end position.
Figure 5:
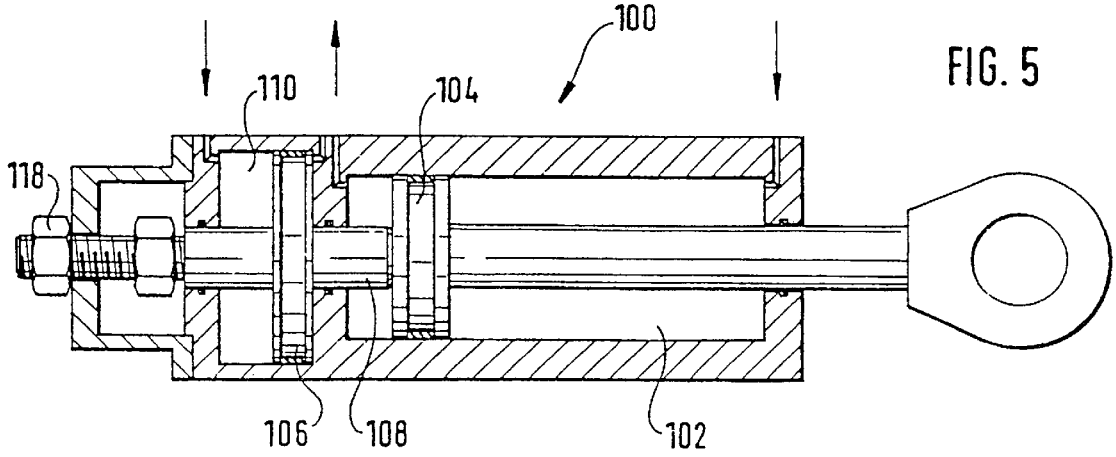
FIG. 5 is a longitudinal section as in FIG. 4, the main piston assuming a second end position.

An advantageous embodiment of the two pressure cylinders 38 and 50 is described with the aid of FIGS. 4 and 5. This is a pressure cylinder 100 with a main piston 104, which is fitted into a cylinder chamber 102, and its stroke in the cylinder chamber 102 is adjustable via an attached stroke limiting device. The latter comprises an auxiliary piston 106 with a piston extension 108, which is sealingly introduced into the cylinder chamber 102. The auxiliary piston 106 seals a pressure chamber 110, on which a pressure medium can act. A connection piece 112 is sealingly led out of the pressure chamber 110 and has a thread 114 with two nuts 116 and 118 screwed on. In FIG. 4 the pressure chamber 110 is pressureless. The main piston 104 rests on the piston extension 108 and can force the latter back as far as the stop of nut 116 on a clamp 120. It is clear that in this position the piston extension 108 projects only slightly into the cylinder chamber 102, so that the main piston stroke corresponds to almost the total length of the cylinder chamber 102.

In FIG. 5 the pressure chamber 110 is exposed to the same pressure as the rear section of the cylinder chamber 102. The piston extension 108 now projects substantially into the cylinder chamber 102 and limits the stroke of the main piston 104. As the cross-section of the pressure chamber 110 sealed by the auxiliary piston 106 is greater than the cross-section of cylinder chamber 102 sealed by the main piston 104, the main piston 104 can no longer force back the piston extension 108. The second nut 118 enables the depth of penetration of the piston extension 108 into the cylinder chamber 102 to be limited.

What is claimed is:

1. A taphole drilling machine to serve two tapholes comprising:

a supporting structure, a mount, a height adjusting mechanism and a vertical tilting device;

wherein said height adjusting mechanism includes:

a frame supported by said supporting structure, a first pressure cylinder with an integrated stroke limiting device with two independently adjustable strokes;

a first supporting joint connecting said height adjusting mechanism to said mount and a first connection joint connecting said height adjusting mechanism to said tilting device;

and is designed in such a way that a stroke of said first pressure cylinder produces a positively guided translation of said first supporting joint and said first connection joint in relation to said frame, so that a connecting line through said first supporting joint and said first connection joint remains parallel with itself during this movement;

wherein said vertical tilting device includes:

a second pressure cylinder with an integrated stroke limiting device with two independently adjustable strokes; and a second supporting joint, connecting said tilting device to said mount; and and is designed in such a way that the distance between said first connection joint and said second supporting joint is adjustable by a stroke of said pressure cylinder.

2. The machine according to claim 1, wherein said height adjusting mechanism is designed as a closed mechanism with a frame and three links interconnected by four swivel joints, wherein:

a first swivel joint connects said frame to a first link;

a second swivel joint connects said frame to a second link; and a third swivel joint and a fourth swivel joint connect a third link to said first link and said second link, so as to close the mechanism.

3. The machine according to claim 2, wherein:

the distance between said first swivel joint and said fourth swivel joint corresponds to the distance between said second swivel joint and said third swivel joint;

the distance between said first swivel joint and said second swivel joint corresponds to the distance between said fourth swivel joint and said third swivel joint; and the distance between said first swivel joint and said first supporting joint corresponds to the distance between said second swivel joint and said first connection joint.

4. The machine according to claim 3, wherein:

said frame comprises a first connection leg carrying said first swivel joint and a second connection leg carrying said second swivel joint;

said first link is L-shaped including a first arm carrying said fourth swivel joint and a second arm carrying said first supporting joint, said first link being connected at the intersection of its first and second arm via said first swivel joint to said frame;

said first link is L-shaped including a first arm carrying said third swivel joint and a second arm carrying said first connection joint, said first link being connected at the intersection of its first and second arm via said second swivel joint to said frame; and said fourth link is rod-shaped and connects said third swivel joint to said fourth swivel joint.

5. The machine according to claim 1, wherein said tilting device is designed as a pantograph.

6. The machine according to claim 1, wherein said stroke limiting device of said first or second pressure cylinder comprises an auxiliary piston for the stroke limitation.

7. The machine according to claim 6, wherein:

said pressure cylinder has a cylinder chamber and a main piston that fits movably in said cylinder chamber; and said auxiliary piston seals in said pressure cylinder a separate pressure chamber with a larger cross-section than said cylinder chamber and has a piston extension that is sealingly introduced into said cylinder chamber in order to limit the stroke of said main piston.

8. The machine according to claim 7, wherein said auxiliary piston has a connection piece that is sealingly led outwards from said pressure chamber and has a thread with two nuts screwed on for adjustable stroke limitation of the auxiliary piston.

9. The machine according to claim 1, wherein the supporting structure comprises an arm for swiveling the mount between two tapholes.

10. A taphole drilling machine to serve two tapholes comprising:

a supporting structure, a mount, a height adjusting mechanism and a vertical tilting device;

wherein said height adjusting mechanism includes:

a frame supporting said mount, a first pressure cylinder with an integrated stroke limiting device with two independently adjustable strokes;

a first supporting joint connecting said height adjusting mechanism to said supporting structure and a first connection joint connecting said height adjusting mechanism to said tilting device;

and is designed in such a way that a stroke of said first pressure cylinder produces a positively guided translation of said first supporting joint and said first connection joint in relation to said frame, so that a connecting line through said first supporting joint and said first connection joint remains parallel with itself during this movement;

wherein said vertical tilting device includes:

a second pressure cylinder with an integrated stroke limiting device with two independently adjustable strokes; and a second supporting joint, connecting said tilting device to said supporting structure; and and is designed in such a way that the distance between said first connection joint and said second supporting joint is adjustable by a stroke of said pressure cylinder.

11. The machine according to claim 10, wherein said height adjusting mechanism is designed as a closed mechanism with a frame and three links interconnected by four swivel joints, wherein:

a first swivel joint connects said frame to a first link;

a second swivel joint connects said frame to a second link; and a third swivel joint and a fourth swivel joint connect a third link to said first link and said second link, so as to close the mechanism.

12. The machine according to claim 11, wherein:

the distance between said first swivel joint and said fourth swivel joint corresponds to the distance between said second swivel joint and said third swivel joint;

the distance between said first swivel joint and said second swivel joint corresponds to the distance between said fourth swivel joint and said third swivel joint; and the distance between said first swivel joint and said first supporting joint corresponds to the distance between said second swivel joint and said first connection joint.

13. The machine according to claim 12, wherein:

said frame comprises a first connection leg carrying said first swivel joint and a second connection leg carrying said second swivel joint;

said first link is L-shaped including a first arm carrying said fourth swivel joint and a second arm carrying said first supporting joint, said first link being connected at the intersection of its first and second arm via said first swivel joint to said frame;

said first link is L-shaped including a first arm carrying said third swivel joint and a second arm carrying said first connection joint, said first link being connected at the intersection of its first and second arm via said second swivel joint to said frame; and said fourth link is rod-shaped and connects said third swivel joint to said fourth swivel joint.

14. The machine according to claim 10, wherein said tilting device is designed as a pantograph.

15. The machine according to claim 10, wherein said stroke limiting device of said first or second pressure cylinder comprises an auxiliary piston for the stroke limitation.

16. The machine according to claim 15, wherein:

said pressure cylinder has a cylinder chamber and a main piston that fits movably in said cylinder chamber; and said auxiliary piston seals in said pressure cylinder a separate pressure chamber with a larger cross-section than the cylinder chamber and has a piston extension that is sealingly introduced into said cylinder chamber in order to limit the stroke of said main piston.

17. The machine according to claim 16, wherein said auxiliary piston has a connection piece that is sealingly led outwards from said pressure chamber and has a thread with two nuts screwed on for adjustable stroke limitation of the auxiliary piston.

18. The machine according to claim 10, wherein said supporting structure comprises an arm for swiveling the mount between two tapholes.

* * * * *